United States Patent [19]

Lazar

[11] 4,381,248

[45] Apr. 26, 1983

[54] COMPOSITION FOR REMOVING CYANOACRYLATE ADHESIVES FROM SURFACES

[76] Inventor: Warren G. Lazar, 8401 N. Rancho Catalina Dr., Tucson, Ariz. 85704

[21] Appl. No.: 293,872

[22] Filed: Aug. 18, 1981

[51] Int. Cl.[3] ..... C11D 7/12; C11D 7/32; C11D 7/50; C23D 17/00

[52] U.S. Cl. ..... 252/118; 252/119; 252/123; 252/153; 252/154; 252/162; 252/171; 252/174.14; 252/174.25; 252/DIG. 8; 134/38; 156/155; 156/331.2; 156/331.6; 156/344

[58] Field of Search ..... 134/38; 156/155, 331.2, 156/331.6, 344; 252/153, 154, 162, 171, 174.14, 118, 119, 123

[56] References Cited

U.S. PATENT DOCUMENTS

| | | | |
|---|---|---|---|
| 2,479,629 | 8/1949 | Kuentzel | 252/539 |
| 2,794,788 | 6/1957 | Coover | 156/295 |
| 3,179,609 | 4/1965 | Morison | 260/28 |
| 3,553,142 | 1/1971 | Figiel | 134/38 X |
| 3,920,472 | 11/1975 | Vinson | 134/38 X |
| 4,085,059 | 4/1978 | Smith | 252/118 |

OTHER PUBLICATIONS

H. Bennett, Editor: *The Chemical Formulary, vol. XIX,* published by Chemical Publishing Co., Inc., New York, 1976, p. 53.

*Azeotropic Data,* Advances in Chemistry Series, No. 6, published Jun. 1952 by Am. Chemical Soc., Wash., D.C., pp. 6 & 41.

*Primary Examiner*—Dennis L. Albrecht

*Attorney, Agent, or Firm*—Harry M. Weiss

[57] ABSTRACT

The invention relates to a composition for removing cyanoacrylate adhesives from surfaces. The composition contains acetonitrile, water, a sodium carbonate, a surfactant and a filler such as ethyl cellulose, starch, bentonite, silica or aluminum octanoate.

1 Claim, No Drawings

COMPOSITION FOR REMOVING CYANOACRYLATE ADHESIVES FROM SURFACES

INTRODUCTION

The present invention relates to cyanoacrylate adhesives and, more particularly, to a novel and unique method and composition for dissolving cyanoacrylate bonds and removing cyanoacrylate adhesives from unwanted sites on industrial and household surfaces.

More particularly, the present invention is predicated upon a formulation comprising acetonitrile and an inert liquid diluent or solvent. A surfactant to which may be added sodium bicarbonate and an organic clay filler may also be present. The composition, when thoroughly mixed into a homogeneous paste and applied to an unwanted deposit of cyanoacrylate adhesive, will dissolve the bond between the adhesive and the surface upon which it is deposited and permit the residue to be easily and quickly wiped up, leaving no marks or scratches where the adhesive deposit had been.

BACKGROUND

The development of cyanoacrylates (also known as 2-cyano-2-propenoic acid methylester), for example, methyl 2-cyanoacrylate; and methyl α-cyanoacrylate represented a major technological advance. The preparation of the cyanoacrylates is described in U.S. Pat. Nos. 2,912,454 and 2,926,188. The use of cyanoacrylate polymers to produce adhesive is described in U.S. Pat. Nos. 2,776,232 and 2,794,788. The cyanoacrylate adhesives, the so-called fast-drying high tensile glues, e.g. Super Glue®, Super Bonder 422, Super Bonder 416, and the like, represented a major breakthrough in the art of bonding and has achieved a myriad of uses, not only in industry and the household, but in surgery as well.

One of the difficulties of the fast-drying glues arises when the user applies more than the minimal amount required, and the excess spreads rapidly from the confines in which it is placed on to surfaces where it is not intended. The glue then rapidly cures to create an unsightly blob in that unwanted position. The spreading glue also has the propensity to attract unwanted objects and firmly bond them to the unwanted site.

Some solvents have been developed to dissolve the bond created by the cyanoacrylates but without exception, each has involved the use of ketones, nitrohydrocarbons, amides or other harsh organic solvents to achieve success. Unfortunately, such harsh chemicals are extremely difficult to work with and are damaging to human flesh and can mar or destroy plastics, for example, the styrenes, such as acetyl butyl styrene, and the acrylates; and natural substances such as rubber.

Thus, a need still exists to develop a method and composition for quickly, easily and safely removing cured cyanoacrylate adhesive from unwanted surfaces which do not rely upon the harsh organic solvents heretofore used.

OBJECTS

Accordingly, a principal object of the present invention is to provide a new and improved method and composition for the removal of cured cyanoacrylate adhesives from unwanted surfaces in a quick, easy and safe fashion while eliminating the problems heretofore attending the prior art use of harsh solvents.

Another object of the present invention is to provide a new and improved method and composition for the removal of cured cyanoacrylate adhesives from unwanted surfaces which composition does not rely upon ketones, nitrohydrocarbons, amides or other extremely harsh organic solvents to achieve success.

A still further object of the present invention is to provide a new and useful composition of the type described which comprises an easily used water-based paste which creates no lasting adverse effect in the surface being cleaned.

These and still further objects, as shall hereinafter appear, are fulfilled by the present invention in a remarkably unexpected fashion as will be readily discerned from the following detailed description of exemplary embodiments thereof.

The present invention relates to my discovery of a unique formulation for dissolving cyanoacrylate bonds and, more particularly, to a new and useful composition which does not depend upon the use of harsh organic solvents for its success.

Further, the present invention relates to my discovery of an improved method for dissolving cyanoacrylate adhesive bonds and removing them harmlessly from unwanted surfaces.

Thus, as will hereafter appear in detail, the present invention provides a method and composition for the dissolution of cyanoacrylate bonds and the removal of cyanoacrylate spills from a wide variety of surfaces in a manner which efficiently cleans the surface without either marring or damaging the surfaces upon which the cured cyanoacrylate was formed.

The composition of this invention consists of an admixture of at least 60 parts by weight of acetonitrile with the balance being an inert liquid solvent or diluent. There may also be present a suitable surfactant (as below described) which then is stirred to homogeneity. However, use of the surfactant is optional, since removal of the cyanoacrylate bond occurs without it. All "parts" indicated herein are on a per weight basis. Optionally, also, the foregoing mixture may be combined with a minor quantity of sodium carbonate or sodium bicarbonate and a sufficient quantity of a rheological agent such as betone (an organic clay filler), silica or a known gellant to thicken the whole. The resulting combination is useful to clear cyanoacrylate adhesive (cyanoacrylate glue) from plastic, glass and metallic surfaces.

DESCRIPTION OF THE INVENTION

In one practice of the present invention, sixty parts of acetonitrile are mixed with 40 parts of an inert diluent such as water, ethanol, acetone, acetic acid or dimethylformamide. To this is added from one to two parts of a surfactant and 40 parts of sodium bicarbonate. (All measurements are stated on a by weight basis.)

The admixture is thoroughly mixed to form a completely homogeneous paste. The paste thus created may then be combined with 50–60 parts (by weight) of a rheological agent selected from the group consisting of bentonite, silica or other gellant to thicken the paste which is immediately useful o clear cyanoacrylate glue from a plastic, glass or metallic surface.

It has been found that many surfactants are acceptable for the practice of the present invention. Thus 1–2 parts by weight of a surfactant selected from the group consisting of polyethylene glycol mono-oleate; alkylaryl polyether alcohol; sorbitan mono-oleate polyoxyethylene; polyoxyethylene alkyl ether; alkylaryl sulfonate; diethylene glycol stearate; ethylenediamine tetra acetadiethanoamide methyl sulfoxide; and the known chemical equivalents thereof may be added to the disclosed acetonitrile-water solution to achieve equally satisfactory results.

Among the optional additives, it has been found that sodium carbonate and sodium bicarbonate are substantially interchangeable in realizing the benefits described.

The rheological additive or gellant may be selected from the group consisting of ethyl cellulose, Montmorillionite clay, sodium stearate, sodium oleate, silica, starch, aluminum octanoate, and the known chemical equivalents thereof without diminishing significantly the benefits to be realized hereby.

In use, the liquid, whether thickened or not, is applied directly upon the unwanted deposit of cyanoacrylate adhesive and allowed to momentarily react with the cyanoacrylate. Thereafter, the mixture and the deposit are readily removed from the surface with a clean rag, and the surface is left clean and without evidence that the deposit was ever there.

In other practices of the present invention, it has been found that any of known surfactants, such as the polycarbonate, stearates and the like can be employed in the formulation described without any substantial variance in the result obtained. Likewise any known rheotological agent of the type indicated can be used, it being believed that only the acetonitrile and the inert liquid diluent or solvent are essential to the basic practice hereof.

To further assist in an understanding of the present invention, not by way of limitation, the following Examples are presented:

EXAMPLE 1

Sixty (60) parts by weight of acetonitrile are mixed with forty (40) parts by weight of water.

EXAMPLE 2

Sixty (60) parts by weight of acetonitrile are mixed with forty (40) parts by weight of ethanol.

EXAMPLE 3

Sixty (60) parts by weight of acetonitrile are mixed with forty (40) parts by weight of water, one (1) part by weight of sorbitan mono-oleate polyoxyethylene and stirred until a completely homogeneous blend is obtained.

EXAMPLE 4

The homogeneous mix prepared according to Example 1 was combined with forty (40) parts by weight of sodium bicarbonate and fifty (50) parts by weight of bentonite (a rheological agent) and stirred until thoroughly admixed.

EXAMPLE 5

The admixture of Example 2 was applied to a styrene surface upon which a glob of cyanoacrylate adhesive (e.g. Super Glue-3 ®, marketed by Woodhill Permatex) had hardened and allowed to set. Thereafter the admixture and the adhesive were wiped with a soft cloth. The styrene surface was completely clean and showed no marks.

EXAMPLE 6

The homogeneous mix prepared according to Example 1 was combined with forty (40) parts by weight of sodium carbonate and sixty (60) parts by weight of silica (a rheological agent) and stirred until thoroughly admixed.

EXAMPLE 7

A glass window pane had strings of cyanoacrylate adhesive dripped thereacross and cured. The composition prepared according to Example 1 was then applied to the cured strings and allowed to set. The composition was then wiped off with a soft rag leaving no adhesive and no scratches or etchings on the window pane.

EXAMPLE 8

The homogeneous mix prepared according to Example 1 was further combined with forty (40) parts by weight of sodium carbonate and forty-five (45) parts by weight of ethyl cellulose and thereafter stirred until thoroughly admixed.

EXAMPLE 9

The admixture of Example 6 was applied to a cured cyanoacrylate adhesive spill on a styrene surface. After a few moments the admixture was wiped clean with a soft rag. The styrene surface showed no sign that the cyanoacrylate has been present.

EXAMPLE 10

From 150–160 parts (by weight) of the mixture prepared according to Example 1 was admixed with forty (40) parts by weight of a sodium carbonate and 40–50 parts by weight of Montmorillonite clay (an organic clay filler). The resulting mixture was useful to clean cured cyanoacrylate glue from glass, plastic and metallic surfaces.

EXAMPLE 11

Forty parts of bentonite, a clay thickener, mixed with 60 parts of sodium carbonate was blended with 160 parts of a mixture prepared according to Example 2. On an aluminum plate, four drops of Super Bonder 416 was evenly spread and allowed to cure for twelve hours. Eight drops of the above identified blend was painted over the cured cyanoacrylate. After 30 seconds, with a durable paper wipe, the super bonder easily rubbed free from the aluminum plate leaving no adverse markings on the plate.

EXAMPLE 12

A blend was prepared according to Example 9 using 50 parts by weight of betonite; 50 parts by weight of sodium carbonate; and 150 parts of the mixture of Example 1. Cured cyanoacrylate adhesive, to which the blend had been applied, was easily wiped free from a polystyrene sheet.

From the foregoing, it is apparent that a novel method and composition for removing unwanted deposits of cyanoacrylate adhesives has been herein described and illustrated which fulfills all of the aforestated objectives in a remarkably unexpected fashion. It is, of course, understood that such alterations, adaptations and modifications as may readily occur to the artisan when confronted with this disclosure are intended within the spirit of this invention, which shall be limited only by the scope of the claims appended hereto.

Accordingly, what I claim and desire to secure by Letters Patent is:

1. A composition consisting essentially of from 150–160 parts by weight of a mixture, formed by mixing 60 parts by weight of acetonitrile with 40 parts by weight of water and 1–2 parts by weight of synthetic surfactant until a homogeneous mixture is obtained, with 40 parts by weight of a compound selected from the group consisting of sodium bicarbonate and sodium carbonate and from 40–50 parts by weight of a filler selected from the group consisting of ethyl cellulose, bentonite montmorillonite clay, sodium stearate, sodium oleate, silica, starch and aluminum octonoate.

* * * * *